US011181034B2

(12) United States Patent
Shidara et al.

(10) Patent No.: US 11,181,034 B2
(45) Date of Patent: Nov. 23, 2021

(54) COOLING SYSTEM

(71) Applicant: DENSO CORPORATION, Kariya (JP)

(72) Inventors: Yukio Shidara, Kariya (JP); Hiroshi Chakida, Kariya (JP)

(73) Assignee: DENSO CORPORATION, Kariya (JP)

( * ) Notice: Subject to any disclaimer, the term of this patent is extended or adjusted under 35 U.S.C. 154(b) by 110 days.

(21) Appl. No.: 16/739,940

(22) Filed: Jan. 10, 2020

(65) Prior Publication Data

US 2020/0149461 A1 May 14, 2020

Related U.S. Application Data

(63) Continuation of application No. PCT/JP2018/024862, filed on Jun. 29, 2018.

(30) Foreign Application Priority Data

Jul. 24, 2017 (JP) ..... JP2017-142389
Jun. 27, 2018 (JP) ..... JP2018-121531

(51) Int. Cl.
*F01P 11/10* (2006.01)
*F01P 7/02* (2006.01)
(Continued)

(52) U.S. Cl.
CPC *F01P 7/12* (2013.01); *F01P 5/06* (2013.01); *F28F 27/02* (2013.01); *F01P 2001/005* (2013.01)

(58) Field of Classification Search
CPC ..... B60K 11/085; B60K 11/08; B60K 11/06; F01P 11/10; F01P 11/20; F01P 1/00; F01P 7/02; F01P 5/06
See application file for complete search history.

(56) References Cited

U.S. PATENT DOCUMENTS 5,566,745 A * 10/1996 Hill ..... B61C 5/02 105/62.2
2011/0061405 A1* 3/2011 Watanabe ..... B60H 1/3227 62/61

(Continued)

FOREIGN PATENT DOCUMENTS

JP 2008106727 A 5/2008
JP 2015101333 A 6/2015

(Continued)

*Primary Examiner* — Long T Tran
(74) *Attorney, Agent, or Firm* — Harness, Dickey & Pierce, P.L.C.

(57) ABSTRACT

A cooling system for a vehicle includes a heat exchanger unit which cools a heat medium by heat exchange with air, a fan which sends air to flow through the heat exchanger unit, and a shutter which switches between an opening and a closing of a pathway through which air flows from an outside toward the heat exchanger unit. A control unit controls operations of the fan and the shutter, an index acquisition unit acquires a heat radiation index showing a magnitude of a radiation amount required in the heat exchanger unit, and a fixing determination unit determines whether the shutter is closed and fixed. The control unit performs a control in which the fan is driven while the shutter is closed, when the heat radiation index is equal to or lower than a predetermined threshold.

5 Claims, 10 Drawing Sheets

(51) Int. Cl.

| | |
|---|---|
| ***B60K 11/08*** | (2006.01) |
| ***F01P 7/12*** | (2006.01) |
| ***F01P 5/06*** | (2006.01) |
| ***F28F 27/02*** | (2006.01) |
| *F01P 1/00* | (2006.01) |

(56) References Cited

U.S. PATENT DOCUMENTS

| | | | | |
|---|---|---|---|---|
| 2014/0120820 | A1* | 5/2014 | Glugla | F02B 29/0493 454/75 |
| 2015/0007731 | A1* | 1/2015 | Shinoda | B01D 53/0462 96/111 |
| 2015/0136353 | A1 | 5/2015 | Niemann et al. | |
| 2015/0343379 | A1* | 12/2015 | Tomimatsu | B01D 53/8675 422/111 |
| 2016/0311406 | A1* | 10/2016 | Deeks | B60K 11/06 |
| 2017/0284275 | A1* | 10/2017 | Nam | F01P 7/10 |
| 2018/0312039 | A1* | 11/2018 | Sakane | F01P 11/10 |
| 2019/0135084 | A1* | 5/2019 | Sato | F01P 11/10 |
| 2019/0211739 | A1* | 7/2019 | Maeda | F01P 7/04 |
| 2019/0248206 | A1* | 8/2019 | Sato | B60H 1/22 |

FOREIGN PATENT DOCUMENTS

| | | | |
|---|---|---|---|
| JP | 2018079757 | A | 5/2018 |
| WO | WO-2017169501 | A1 | 7/2018 |

* cited by examiner

COOLING SYSTEM

CROSS REFERENCE TO RELATED APPLICATION

The present application is a continuation application of International Patent Application No. PCT/JP2018/024862 filed on Jun. 29, 2018, which designated the U.S. and claims the benefit of priority from Japanese Patent Applications No. 2017-142389 filed on Jul. 24, 2017 and No. 2018-121531 filed on Jun. 27, 2018. The entire disclosures of all of the above applications are incorporated herein by reference.

TECHNICAL FIELD

The present disclosure relates to a cooling system that is equipped in a vehicle.

BACKGROUND

A cooling system is equipped in an engine room located at a frontward of a vehicle, and may cool various heat mediums such as a coolant, a refrigerant for air conditioner by heat exchange with air.

SUMMARY

According to an aspect of the present disclosure, a cooling system includes a heat exchanger unit configured to cool a heat medium by heat exchange with air, a fan configured to send air to flow through the heat exchanger unit, and a shutter configured to switch between an opening and a closing of a pathway through which air flows from an outside of the vehicle toward the heat exchanger unit. A control unit is configured to control an operation of the fan and an operation of the shutter, and an index acquisition unit is configured to acquire a heat radiation index that is an index showing a magnitude of a radiation amount required in the heat exchanger unit.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
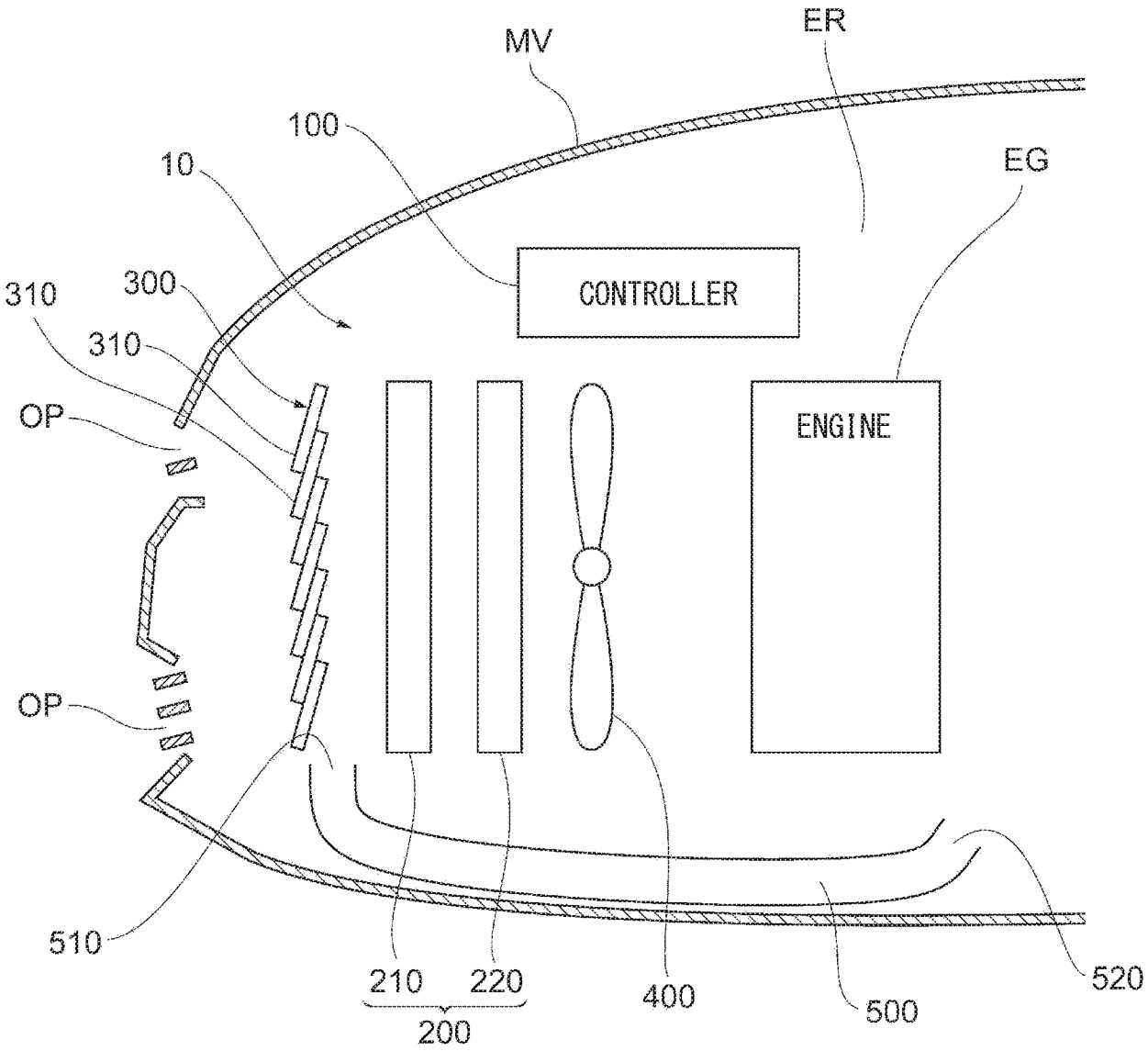
FIG. 1 is a schematic diagram showing an overall structure of a cooling system according to a first embodiment.

A cooling system may be equipped in an engine room located at a frontward of a vehicle, and may cool various heat mediums such as a coolant, a refrigerant for air conditioner by heat exchange with air. The cooling system is, for example, configured as a module in which a single heat exchanger or a plurality of heat exchangers is combined with a shutter and a fan and the like.

In an example, the heat exchanger unit is located at a front part of a module in the cooling system, and is operated as a condenser to cool and condense the refrigerant. When the refrigerant is cooled, the shutter is opened, and the fan is driven if required, so that outside air introduced from the frontward of the vehicle is supplied to the heat exchanger unit.

When the shutter is opened, air resistance in which the vehicle receives during traveling is increased, and fuel efficiency is reduced. However, in the cooling system described above, the shutter is opened constantly in a case where cooling at the heat exchanger unit is required. Due to this, the fuel efficiency is reduced in the cooling system such as described above.

An opening of the shutter may be throttled to a minimum size required for the cooling system in order to restrain the air resistance from increasing. However, when the shutter is opened even by slightly, the fuel efficiency is reduced to the extent being not negligible due to the increasing of the air resistance. On the other hand, if the shutter is closed completely, the heat exchanger unit is not cooled.

The present disclosure is provided with a cooling system which can reduce a frequency of opening a shutter, for example.

According to an exemplar embodiment of the present disclosure, a cooling system may be equipped in a vehicle. The cooling system includes a heat exchanger unit which cools a heat medium by heat exchange with air, a fan which sends air to flow through the heat exchanger unit, a shutter which switches between an opening and a closing of a pathway through which air flows from an outside of the vehicle toward the heat exchanger unit, a control unit which controls an operation of the fan and an operation of the shutter, an index acquisition unit which acquires a heat radiation index that is an index showing a magnitude of a radiation amount required in the heat exchanger unit, and a fixing determination unit which determines whether the shutter is closed and fixed. The control unit performs an inside air cooling control in which the fan is driven while the shutter is closed, when the heat radiation index is equal to or lower than a predetermined threshold, or/and when the fixing determination unit determines the shutter is closed and fixed.

In the cooling system according to the exemplar embodiment described above, the control unit performs the inside air cooling control, when the heat radiation index is equal to or lower than the threshold, that is, when the required radiation amount of the heat exchanger unit is relatively small. In the inside air cooling control, the fan is driven while the shutter is closed. That is, supply of air from an outside of the vehicle to a heat exchanger unit is stopped. However, the fan is configured to generate a flow of air passing through the heat exchanger unit, and the heat medium, such as a coolant and a refrigerant, is cooled at the heat exchanger unit. At this case, the shutter is closed, and air resistance to the vehicle is restricted from increasing.

In the cooling system described above, the heat medium may be cooled to perform heat radiation, at the heat exchanger unit even when the shutter is closed. Due to this, a frequency of opening the shutter in the cooling system can be reduced from that in a conventional system. Therefore, fuel efficiency of the vehicle can be enhanced.

According to the exemplar embodiment of the present disclosure, the frequency of opening the shutter in the cooling system is reduced.

Detail embodiments of the present disclosure will be described with reference to the accompanying drawings as follows. The same reference numerals in the drawings are given to the same structures in order to eliminate explanation for easily understanding.

A structure of a cooling system 10 according to a first embodiment will be described with reference to FIG. 1. The cooling system 10 is located in an engine room ER at a frontward of a vehicle MV, that is, at a left side in FIG. 1. The cooling system 10 is placed closer to the frontward of the vehicle MV than the engine EG. The cooling system 10 includes a heat exchanger unit 200, a shutter 300, a fan 400, and a controller 100. The entire of the cooling system constitutes one module. The controller 100 may be distant from the module of the cooling system.

The heat exchanger unit 200 is configured to cool the heat medium by heat exchange with air. The heat exchanger unit 200 in the present embodiment includes a condenser 210 and a radiator 220. The condenser 210 and the radiator 220 are arranged in a front-rear direction of the vehicle MV.

The condenser 210 is a part of an unillustrated air conditioner equipped in the vehicle MV and is a heat exchanger configured to cool a refrigerant for air conditioning by the heat exchange with air. The condenser 210 is configured to cool the refrigerant which circulates a refrigeration cycle and to condense the refrigerant. That is, in the condenser 210, the refrigerant for the air conditioning is used as the heat medium.

The radiator 220 is a heat exchanger configured to cool coolant of the engine EG by the heat exchange with air. The radiator 220 is configured to cool the coolant at high temperature, caused by passing through the engine EG, by the heat exchange with air. That is, the coolant is used as the heat medium in the radiator 220. The radiator 220 is placed on a rearward of the vehicle MV than the condenser 210. However, the radiator 220 may be placed on the frontward of the vehicle MV than the condenser 210.

The condenser 210 and the radiator 220 both include multiple tubes through which the heat medium passes. A fin is interposed between the tubes, and the tubes are laminated. Air flows between the tubes along the front and the rear direction of the vehicle MV. A known configuration may be used for the heat exchanger described above. Therefore, specific drawing and explanation are eliminated.

The shutter 300 is configured to switch between an opening and an closing of a pathway through which air flows from an outside of the vehicle MV toward the heat exchanger unit 200, more specifically, a pathway through which air passed through an opening OP at a front grill reaches to the heat exchanger unit 200. The shutter 300 in the present embodiment is placed on the frontward of the vehicle MV than the heat exchanger unit 200, more specifically, on the side of the front of the vehicle MV than the condenser 210. However, the shutter 300 may be placed between the condenser 210 and the radiator 220.

Figure 3:
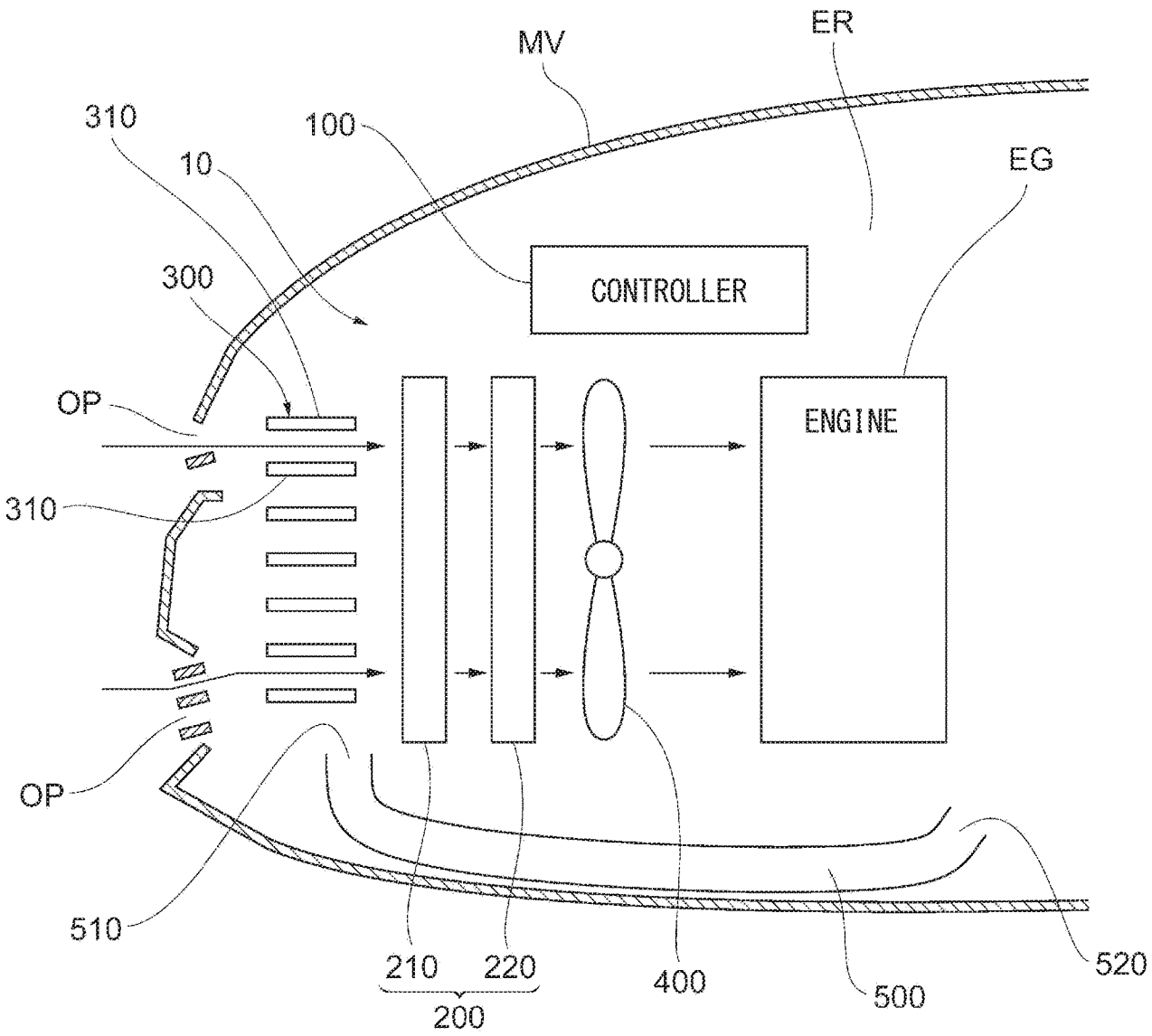
FIG. 3 is a schematic diagram showing a flow of air during an operation of the cooling system.

The shutter 300 includes multiple blades 310 arranged in a vertical direction. The blade 310 is a plate-shaped member. The blade 310 is enabled to rotate about a rotation shaft arranged in a horizontal direction, that is, in depth direction of paper surface in FIG. 1, of the vehicle MV with a driving force from an unillustrated actuator. Due to this, a state in which the shutter 300 is closed as shown in FIG. 1, that is, state in which opening is 0%, and a state in which the shutter 300 is opened as shown in FIG. 3, that is, state in which opening is 100%, can be switched. The controller 100 controls an operation of the shutter 300. The opening of the shutter 300 may be freely set in a range of 0% to 100%.

When the shutter 300 is closed as shown in FIG. 1, the blades 310 abut against one another, and clearance is not formed between the blades 310. At this point, air from the opening OP is blocked by the shutter 300 and does not reach the heat exchanger unit 200.

When the shutter 300 is opened as shown in FIG. 3, the blades 310 are separated from one another, and the clearances are formed between the blades 310, respectively. In this state, air from the opening OP passes through the clearance between the blades 310 and reaches the heat exchanger unit 200.

Figure 4:
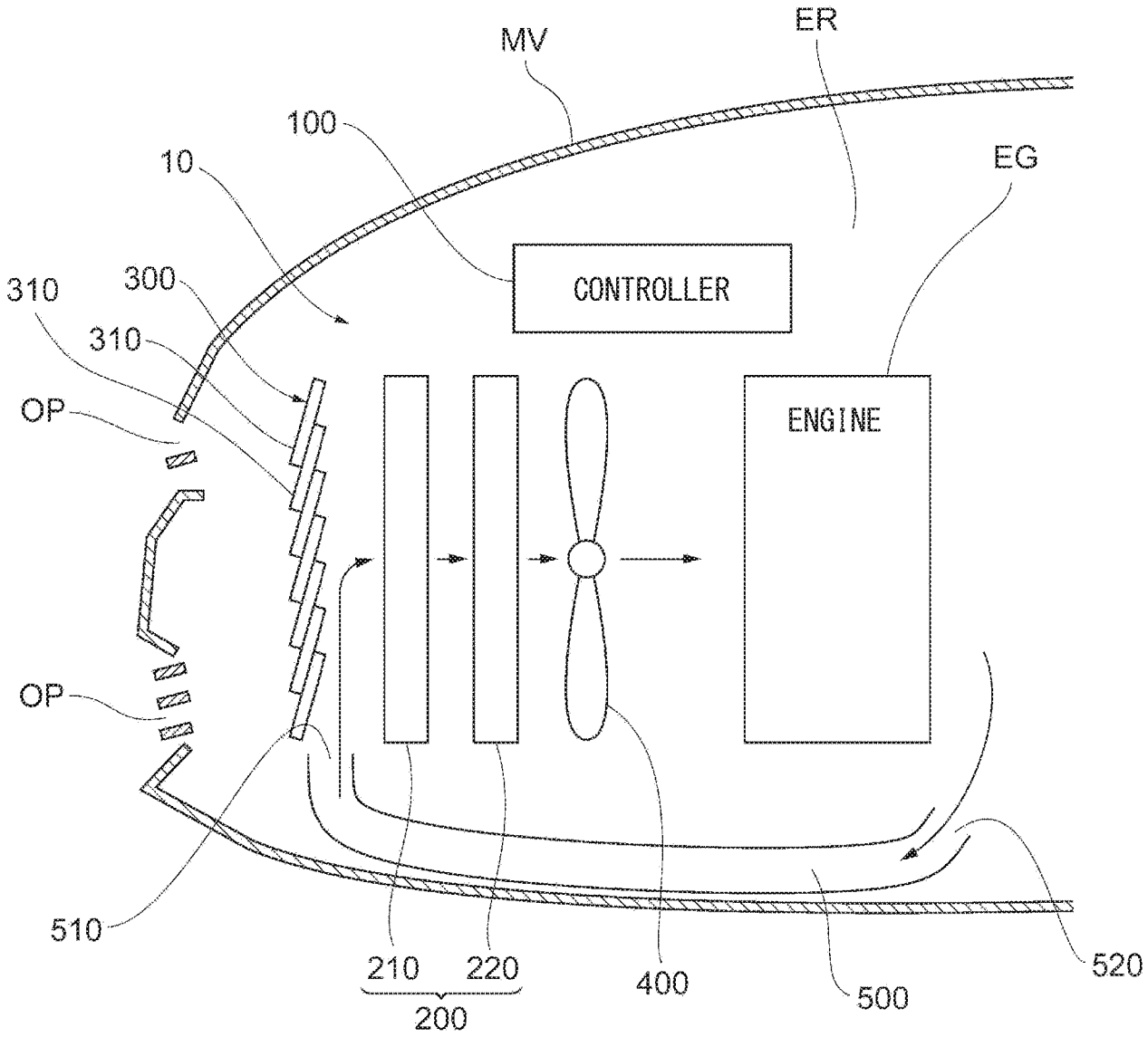
FIG. 4 is a schematic diagram showing a flow of air during an operation of the cooling system.
Figure 5:
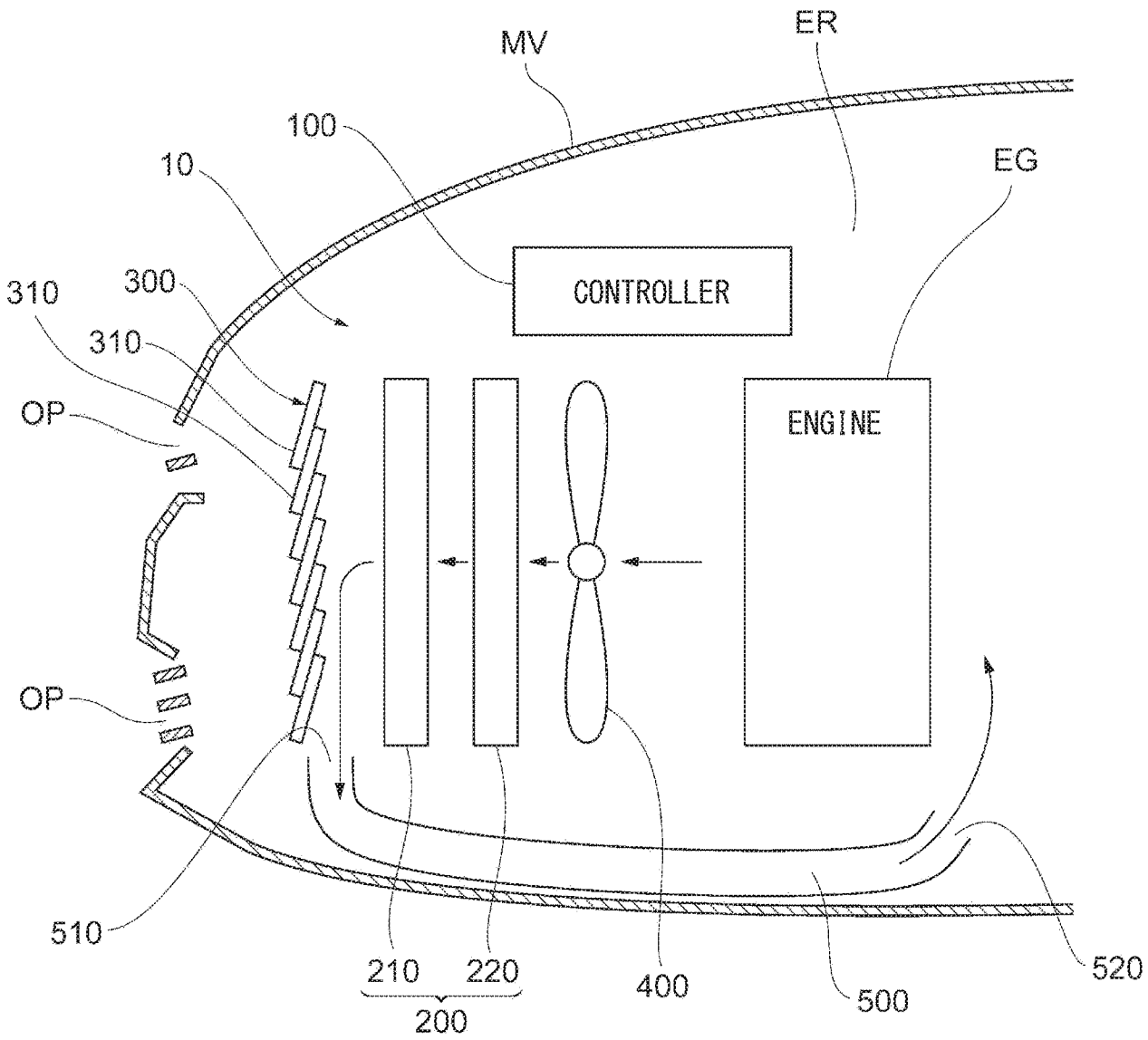
FIG. 5 is a schematic diagram showing a flow of air during an operation of the cooling system.

The fan 400 is configured to send air to flow to the heat exchanger unit 200. The fan 400 is placed on the rearward of the vehicle MV than the heat exchanger unit 200. The fan 400 is enabled not only to rotate in a forward direction so as to send air toward the engine EG positioned at the rear of the heat exchanger unit 200, as shown in FIGS. 3 and 4, but also to rotate in a reverse direction so as to send air to the heat exchanger unit 200 positioned at the front of the engine, as shown in FIG. 5. The controller 100 controls an operation of the fan 400.

As described above, in the cooling system 10 in the present embodiment, the shutter 300, the condenser 210, the radiator 220, and the fan 400 are equipped in this order from the frontward toward the rearward of the vehicle MV.

An under duct 500 is placed at a side lower than the cooling system 10 in the vehicle MV. The under duct 500 is a pathway and connects a space in which the cooling system 10 is placed to a space at the rearward than the engine EG in the engine room ER.

An opening 510 is provided at an end of the under duct 500 at the frontward. The opening 510 is directed to a position between the shutter 300 which is closed and the condenser 210, that is, heat exchanger unit 200. An opening 520 is provided at an end of the under duct 500 at the rearward. The opening 520 is directed to an area at the rearward than the engine EG in the engine room ER. An advantage of providing the under duct 500 described above will be described below.

The controller 100 is configured to control the whole operation of the cooling system 10. The controller 100 is a computer system which includes CPU, ROM, RAM, and the like. The controller 100 may be adjacent to the heat exchanger unit 200 which is systemized, or may be separated from the heat exchanger unit 200 or the like. The controller 100 may be an exclusive unit which controls the operation of the shutter 300, the fan 400, or the like. The controller 100 may be a part of another ECU equipped in the vehicle MV.

Figure 2:
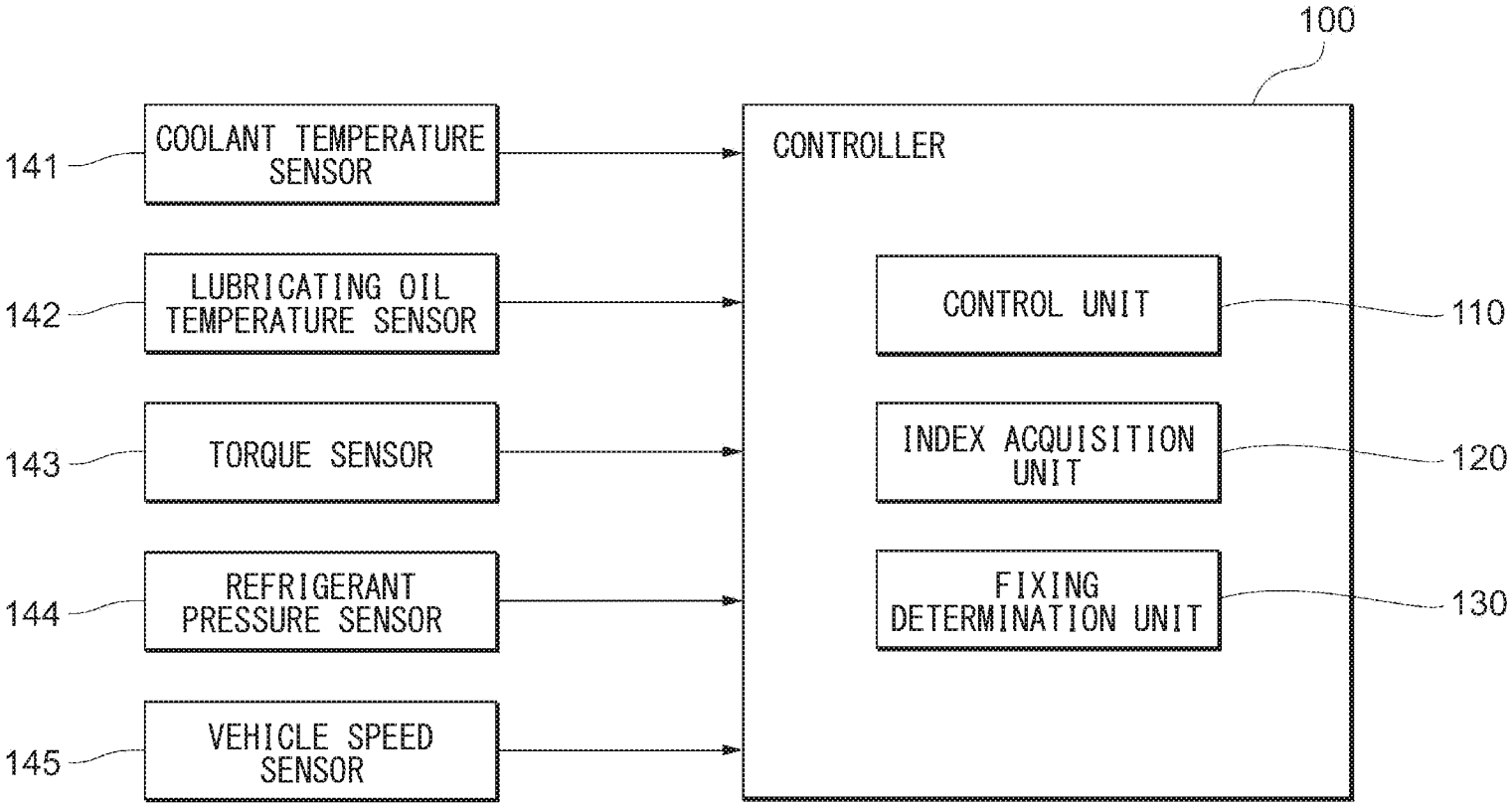
FIG. 2 is a block diagram showing a structure of a controller in the cooling system.

A structure of the controller 100 will be described with reference to FIG. 2. The controller 100 includes a control unit 110, an index acquisition unit 120, and a fixing determination unit 130 as a functional control block.

The control unit 110 is configured to control the operation of the fan 400 and the operation of the shutter 300. As described above, the fan 400 is enabled to rotate in the forward direction and in the reverse direction. The control unit 110 is enabled to perform a forward rotation mode and a reverse rotation mode. In the forward rotation mode, the fan 400 rotates so as to send air from the fan 400 toward the rearward of the vehicle MV, that is, rotates in forward direction. In the reverse rotation mode, the fan 400 rotates so as to send air from the fan 400 toward the frontward of the vehicle MV.

The index acquisition unit 120 is configured to acquire an index, referred to as heat radiation index hereinafter, which shows a magnitude of a required radiation amount in the heat exchanger unit 200. The required radiation amount in the heat exchanger unit 200 increases as a coolant temperature raises due to a load raising of the engine EG. Therefore, the index acquisition unit 120 in the present embodiment is configured to acquire the temperature of the coolant which flows in the engine EG as the heat radiation index. Instead of this embodiment, the index acquisition unit 120 may acquire a temperature of lubricating oil which flows in the engine EG as the heat radiation index. The index acquisition unit 120 may acquire both the coolant temperature and the lubricating oil temperature as the heat radiation index. Alternatively, the index acquisition unit 120 may acquire a temperature of transmission oil, motor cooling oil, or the like, as the heat radiation index.

The required radiation amount at the heat exchanger unit 200 is a total of a radiation amount required in the condenser 210 and a radiation amount required in the radiator 220.

The fixing determination unit 130 is configured to determine whether or not the shutter 300 is closed and fixed. In the shutter 300, due to a freeze, clogging by foreign object to a mechanical part, or the like, the blade 310 may be fixed and may not operate. The "closed and fixed state" means that the shutter 300 is fixed while the shutter 300 is kept closed as described above. The fixing determination unit 130 determines whether or not the shutter 300 is closed and fixed based on a signal from a torque sensor 143 which will be described below. The fixing determination unit 130 may determine whether or not the shutter 300 is closed and fixed based on a value of current which flows through the actuator of the shutter 300.

Signals from multiple sensors which are placed at each parts of the vehicle MV are input to the controller 100. FIG. 2 shows a coolant temperature sensor 141, a lubricating oil temperature sensor 142, the torque sensor 143, a refrigerant pressure sensor 144, and a vehicle speed sensor 145 in the multiple sensors described above.

The coolant temperature sensor 141 is a temperature sensor configured to detect the temperature of the coolant which flows in the engine EG. As described above, the index acquisition unit 120 acquires the coolant temperature detected by the coolant temperature sensor 141 as the heat radiation index.

The lubricating oil temperature sensor 142 is a temperature sensor configured to detect the temperature of the lubricating oil which flows in the engine EG. As described above, the lubricating oil temperature detected by the lubricating oil temperature sensor 142 may be used as the heat radiation index.

The torque sensor 143 is a sensor configured to measure a magnitude of torque generated by the actuator of the shutter 300. The fixing determination unit 130 determines that the shutter 300 is closed and fixed, in a case where the torque measured by the torque sensor 143 is larger than a predetermined value when the shutter 300 is driven. The torque sensor 143 may be included in the actuator of the shutter 300.

The refrigerant pressure sensor 144 is a sensor configured to measure pressure of the refrigerant which passes through the condenser 210. The vehicle speed sensor 145 is a sensor configured to measure a traveling speed, that is, vehicle speed, of the vehicle MV. As described below, the pressure detected by the refrigerant pressure sensor 144 and the vehicle speed detected by the vehicle speed sensor 145 are used for a processing determination performed by the controller 100.

A summary of the control performed by the controller 100 will be described below. FIG. 3 shows a flow of air when the cooling system 10 operates in a state where the required radiation amount of the heat exchanger unit 200 is relatively large. In a state of FIG. 3, the shutter 300 is fully opened, and the fan 400 operates in the forward rotation mode. Due to this, outside air flows into the engine room through the opening OP and flows from the frontward toward the rearward of the vehicle. The outside air passes through the heat exchanger unit 200 and cools the heat medium.

In the state of FIG. 3, the shutter 300 is opened. Therefore, the air resistance received by the vehicle MV is high. On the other hand, the heat medium is cooled efficiently by outside air at a low temperature. Therefore, heat radiation can be sufficiently performed at the heat exchanger unit 200, even when the required radiation amount of the heat exchanger unit 200 is relatively large.

FIG. 4 shows a flow of air when the cooling system 10 operates in a state where the required radiation amount of the heat exchanger unit 200 is relatively small. In a state of FIG. 4, the shutter 300 is closed, and the fan 400 operates in the forward rotation mode. That is, outside air flowing from the opening OP does not reach the heat exchanger unit 200 directly.

Air sent from the fan 400 toward the rearward passes around the engine EG. Subsequently, the air flows into the under duct 500 through the opening 520 and is discharged from the opening 510. The air from the opening 510 passes through the condenser 210 and the radiator 220 in this order and is sent toward the rearward by the fan 400 again.

In the state of FIG. 4, a flow of air which passes through the heat exchanger unit 200 is generated even when the shutter 300 is closed. Therefore, the heat medium at the heat exchanger unit 200 is cooled. A control performed by the control unit 110 to be in the state of FIG. 4 described above, that is, a control in which the fan 400 is driven while the shutter 300 is closed, is referred to as an inside air cooling control hereinafter. The shutter 300 is closed during performing the inside air cooling control. Therefore, the air resistance received by the vehicle MV is reduced.

In the state of FIG. 4, air circulates through a passage which passes through the under duct 500. Due to this, a phenomenon (short circuit) in which air is whirled and passes through the heat exchanger unit 200 again shortly after passed through the heat exchanger unit 200 is restricted. Therefore, the heat radiation from the heat exchanger unit 200 during the inside air cooling control is performed more efficiently, in comparison with a case where the under duct 500 is not provided.

The radiation amount from the heat exchanger unit 200 in the state of FIG. 4 is lower than the radiation amount in the state of FIG. 3. However, when the required radiation amount of the heat exchanger unit 200 is relatively small, the reduction of the radiation amount is not a problem.

When the required radiation amount of the heat exchanger unit 200 is relatively small, the cooling system 10 may become in a state of FIG. 5 instead of the state of FIG. 4. In the state of FIG. 5, the shutter 300 is closed, and the fan 400 operates in the reverse rotation mode. In this state, outside air flowing from the opening OP does not reach the heat exchanger unit 200.

Air sent from the fan 400 toward the frontward passes through the radiator 220 and the condenser 210 in this order. Subsequently, the air flows from the opening 510 into the under duct 500 and is discharged from the opening 520 toward the rearward than the engine EG. The air passing around the engine EG toward the frontward is sent to the frontward by the fan 400 again.

That is, when the inside air cooling control is performed in the reverse rotation mode, air which has passed through the heat exchanger unit 200 is supplied toward the engine EG through the under duct 500. In other words, the heat exchanger unit 200, the fan 400, and the shutter 300 are arranged, respectively, such that air circulates as described above. In this case, the under duct 500 guides air which has passed through the heat exchanger unit 200 in the reverse rotation mode to flow toward the engine EG, more specifically, toward the rearward than the engine EG.

Similarly to the state of FIG. 4 described above, in the state of FIG. 5, air circulates through the passage which passes through the under duct 500. Therefore, flow rate of air which circulates is increased, in comparison with the case where the under duct 500 is not provided.

That is, the inside air cooling control which drives the fan 400 in the state where the shutter 300 is closed may be performed either in the forward rotation mode shown in FIG. 4 or in the reverse rotation mode shown in FIG. 5.

Figure 6A:
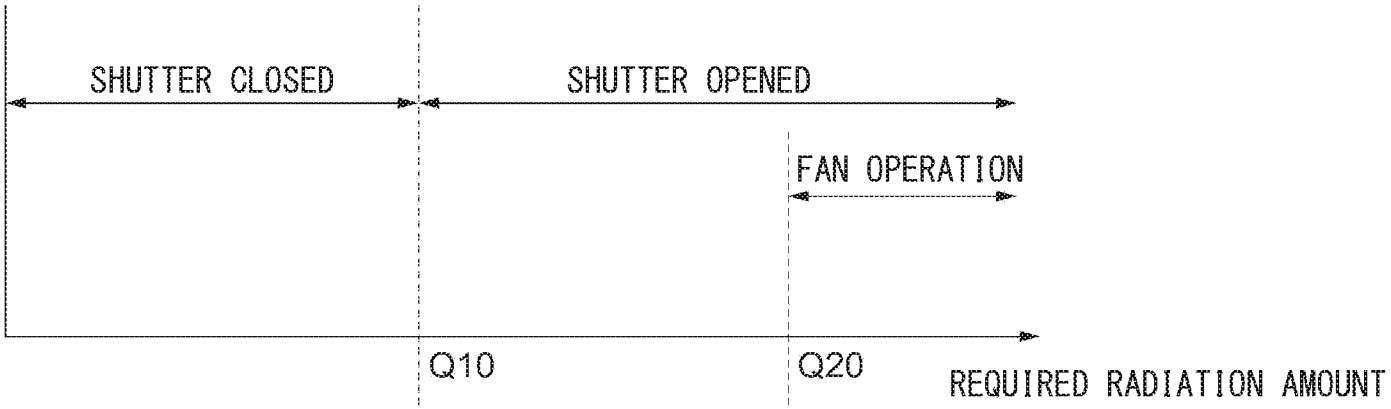
FIGS. 6A and 6B are diagrams to explain operating conditions of a shutter and a fan.

Operating conditions of the shutter 300 and the fan 400 will be described with reference to FIGS. 6A and 6B. FIG. 6A shows the operating conditions of the shutter 300 and the fan 400 in a comparative example in which the inside air cooling control is not performed. In the comparative example, the shutter 300 is closed when the required radiation amount is smaller than Q10. On the other hand, the shutter 300 is opened when the required radiation amount is larger than the Q10. In addition, the fan 400 starts operation when the required radiation amount is further increased and becomes larger than Q20.

Figure 6B:
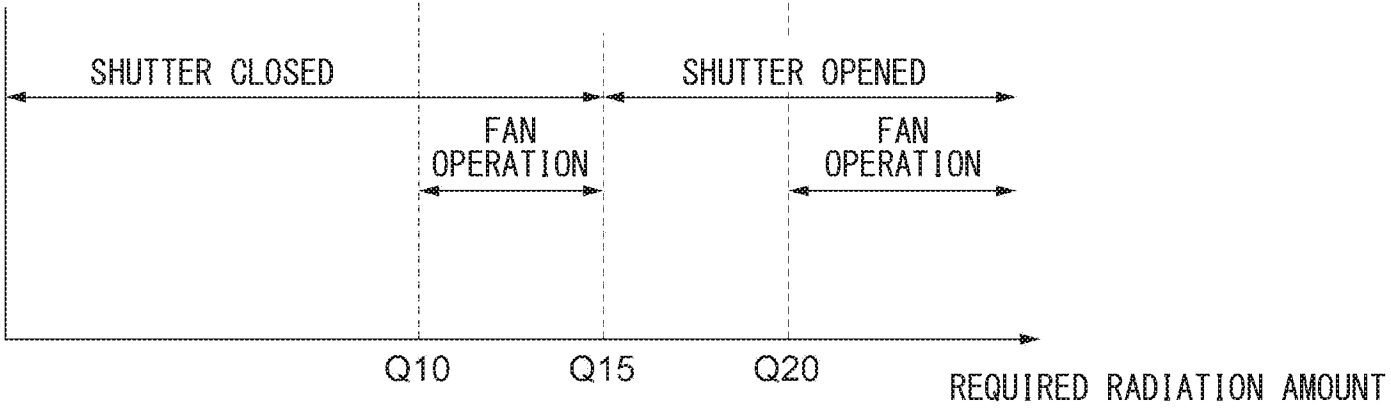

FIG. 6B shows the operating condition of the shutter 300 and the fan 400 in the present embodiment. In the cooling system in the present embodiment, when the required radiation amount is smaller than the Q10, the shutter 300 is closed, similarly to the comparative example. However, the shutter 300 keeps closed when the required radiation amount is more than the Q10. At this point, the fan 400 is driven while the shutter 300 is closed, and the inside air cooling control described above is performed.

When the required radiation amount is more than Q15, the shutter 300 is opened, and the operation of the fan 400 is stopped. Subsequently, when the required radiation amount is further increased and becomes larger the Q20, the operation of the fan 400 starts in the present embodiment.

As shown in FIGS. 6A and 6B, a range of the required radiation amount (<Q15) in the present embodiment in which the shutter 300 is closed is wider than a range of the required radiation amount (<Q10) in the comparative example, in which the shutter 300 is closed. Due to this, in the cooling system 10, a frequency of opening the shutter 300 can be reduced from that in a conventional system, while the heat exchanger unit 200 keeps performing the heat radiation which is required. Therefore, fuel efficiency of the vehicle MV is enhanced.

Detail of a processing performed by the controller 100 to perform the control described above will be described with reference to FIG. 7. The controller 100 performs the series of the processing shown in FIG. 7 repeatedly, at every time when a predetermined control cycle elapses. The processing is mainly performed by the control unit 110.

Step S01 determines whether or not the shutter 300 is closed and fixed. As described above, the fixing determination unit 130 determinates whether or not the shutter 300 is closed and fixed. When the fixing determination unit 130 determines the shutter 300 is closed and fixed, that is, when the fixing determination unit 130 determines the shutter 300 is kept closed, the processing is transferred to step S02.

Step S02 determines whether or not the coolant temperature detected by the coolant temperature sensor 141 is equal to or higher than a predetermined threshold T1. The threshold T1 is set beforehand as a coolant temperature which is required for the heat radiation at the radiator 220. When the coolant temperature is lower than the threshold T1, the processing at step S02 is performed repeatedly. When the coolant temperature is equal to or higher than the threshold T1, the processing is transferred to step S03.

At step S03, a processing to drive the fan 400 is performed. Due to this, air passes through the heat exchanger unit 200, and the heat radiation from the coolant is performed at the radiator 220. At step S03 and thereafter, the inside air cooling control in which the fan 400 is driven in a state where the shutter 300 is closed is performed.

At step S04 after step S03, a processing to stop an operation of the air conditioner equipped in the vehicle MV is performed. Due to this, the heat radiation from the refrigerant which passes through the condenser 210 is stopped, and the heat radiation from the radiator 220 is performed efficiently. Step S03 may be performed after step S04.

Step S05 after step S04 determines whether or not the coolant temperature detected by the coolant temperature sensor 141 is equal to or higher than a predetermined upper limit temperature T2. The upper limit temperature T2 is set beforehand as a temperature at which overheating is determined. The upper limit temperature T2 is higher than the threshold T1. When the coolant temperature is lower than the upper limit temperature T2, the processing at step S02 and thereafter is performed again. Accordingly, the vehicle MV traveling continues. When the coolant temperature is equal to or higher than the upper limit temperature T2, the processing is transferred to step S06.

Figure 7:
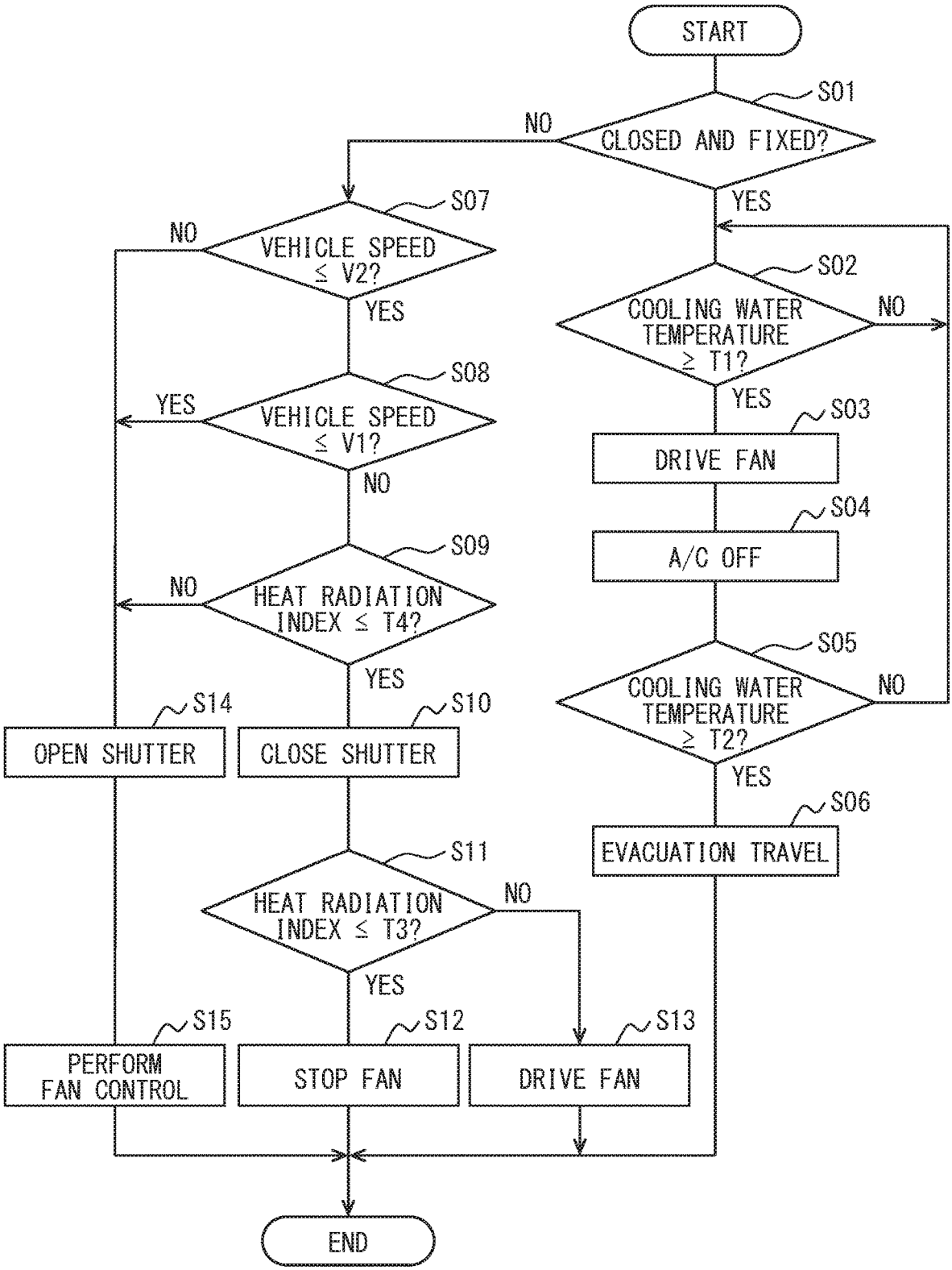
FIG. 7 is a flow chart showing a flow of a processing performed by the controller.

The transfer to step S06 indicates that the coolant temperature is raised and the vehicle MV is overheated, though the inside air cooling control tried to cool the coolant. Therefore, at step S06, an "evacuation travel" is performed for the vehicle MV so as to stop the vehicle MV safety. More specifically, step S06 performs a processing to reduce forcibly an output of the engine EG and to light up a warning light (MIL) in the interior of the vehicle. Subsequently, the series of the processing shown in FIG. 7 is finished.

As described above, when the fixing determination unit 130 determines that the shutter 300 is closed and is in a fixed state, the control unit 110 in the present embodiment performs the inside air cooling control at step S03. Therefore, the vehicle MV is enabled to continue to drive for a while, even in a case where outside air is restricted from flowing into the engine room ER.

If the fixing determination unit 130 determines that the shutter 300 is not closed and fixed at step S01, the processing is transferred to step S07. Step S07 determines whether or not the vehicle speed measured by the vehicle speed sensor 145 is equal to or lower than a predetermined upper limit speed V2. The upper limit speed V2 is set beforehand as a speed at which a breakage of the shutter 300 (for example, the blade 310) is not caused by wind pressure when the vehicle MV drives in a condition in which the shutter 300 closed. When the vehicle speed is equal to or lower than the upper limit speed V2, the processing is transferred to step S08.

Step S08 determines whether or not the vehicle speed measured by the vehicle speed sensor 145 is equal to or lower than a predetermined threshold speed V1. The threshold speed V1 is a speed set beforehand as a lower limit value of a range of the vehicle speed suitable for performing the inside air cooling control. The threshold speed V1 is lower than the upper limit speed V2.

As described above, the fuel efficiency of the vehicle MV may be enhanced when the shutter 300 is closed. However, effect of enhancing the fuel efficiency is reduced when the vehicle speed is low. On the other hand, when the inside air cooling control is performed, electricity is required to drive the fan 400, and therefore, the fuel efficiency of the vehicle MV is reduced.

The threshold speed V1 is calculated and set beforehand as a lower limit value of a speed range in which the enhancement of the fuel efficiency due to the closing of the shutter 300 exceeds the reduction of the fuel efficiency due to the driving of the fan 400.

At step S08, when the vehicle speed is more than the threshold speed V1, the processing is transferred to step S09. Step S09 determines whether or not the coolant temperature detected by the coolant temperature sensor 141, that is, the heat radiation index acquired by the index acquisition unit 120, is equal to or lower than a predetermined threshold T4. The threshold T4 is a threshold set beforehand as an upper limit value of the heat radiation index capable of sufficiently keeping the vehicle MV when the shutter 300 is closed. When the coolant temperature (heat radiation index) is equal to or lower than the threshold T4, the processing is transferred to step S10.

At step S10, a processing to close the shutter 300 is performed. When the shutter 300 has already closed at this point, the closing state of the shutter 300 is maintained.

Step S11 after step S10 determines whether or not the coolant temperature detected by the coolant temperature sensor 141, that is, the heat radiation index acquired by the index acquisition unit 120, is equal to or lower than a predetermined threshold T3. The threshold T3 is a threshold set beforehand as an upper limit value of a range of the heat radiation index capable of sufficiently keeping the vehicle MV without the inside air cooling control. The threshold T3 is lower than the threshold T4. When the coolant temperature (heat radiation index) is equal to or lower than the threshold T3, the processing is transferred to step S12.

At step S12, a processing to stop the operation of the fan 400 is performed. When the operation of the fan 400 has already stopped at this point, the stopping state of the fan 400 is maintained at step S12. At step S12 and thereafter, the shutter 300 is closed, and the operation of the fan 400 is stopped. In this state, because the coolant temperature (heat radiation index) is low enough, a problem, such as the overheating or the like, is not caused.

When the coolant temperature (heat radiation index) is more than the threshold T3 at step S11, the processing is transferred to step S13. At step S13, a processing to start the operation of the fan 400 is performed. When the operation of the fan 400 has already started at this point, the operation of the fan 400 is maintained at step S13. At step S13 and thereafter, the shutter 300 is closed, and the fan 400 operates, that is, the inside air cooling control is performed. Due to this, the heat radiation from the heat exchanger unit 200 is performed while the shutter 300 is closed.

At step S09, when the coolant temperature (heat radiation index) is more than the threshold T4, the processing is transferred to step S14. The transfer to step S14 from step S09 indicates that the heat radiation index is relatively large, and the heat radiation by the inside air cooling control is not enough. Due to this, a processing to open the shutter 300 is performed at step S14. In a state where the shutter 300 has already been opened at step S14, the open state of the shutter 300 is maintained.

At step S15 after step S14, a control to adjust a revolution of the fan 400 is performed and is referred to as fan control hereinafter. The fan control is performed in the forward rotation mode shown in FIG. 3. Due to this, efficiency of the heat radiation at the heat exchanger unit 200 is enhanced. Therefore, the heat medium is cooled efficiently. The fan control includes a processing to stop the operation of the fan 400 and to radiate the heat from the heat exchanger unit 200 only by vehicle speed wind entered from the opening OP.

At step S08, when the vehicle speed is equal to or lower than the threshold speed V1, the processing is transferred to step S14. In a case where the vehicle speed is equal to or lower than the threshold speed V1, the fuel efficiency of the vehicle MV is reduced by performing the inside air cooling control. Therefore, instead of the inside air cooling control, the processing at step S14 and the processing at step S15 are performed.

At step S07, when the vehicle speed is more than the upper limit speed V2, the processing is transferred to step S14. In a case where the vehicle speed is more than the upper limit speed V2, the breakage of the blade 310 or the like by wind pressure may be occurred when the shutter 300 is closed. Therefore, instead of the inside air cooling control, the processing at step S14 and the processing at step S15 are performed. That is, the control unit 110 in the present embodiment does not perform the inside air cooling control, in a case where the vehicle speed is more than the upper limit speed V2.

When the fan 400 starts driving at step S03 or step S13, the forward rotation mode or the reverse rotation mode is performed. In the present embodiment, the control unit 110 performs a processing shown in FIG. 8, and determining whether the forward rotation mode or the reverse rotation mode is performed.

Figure 8:
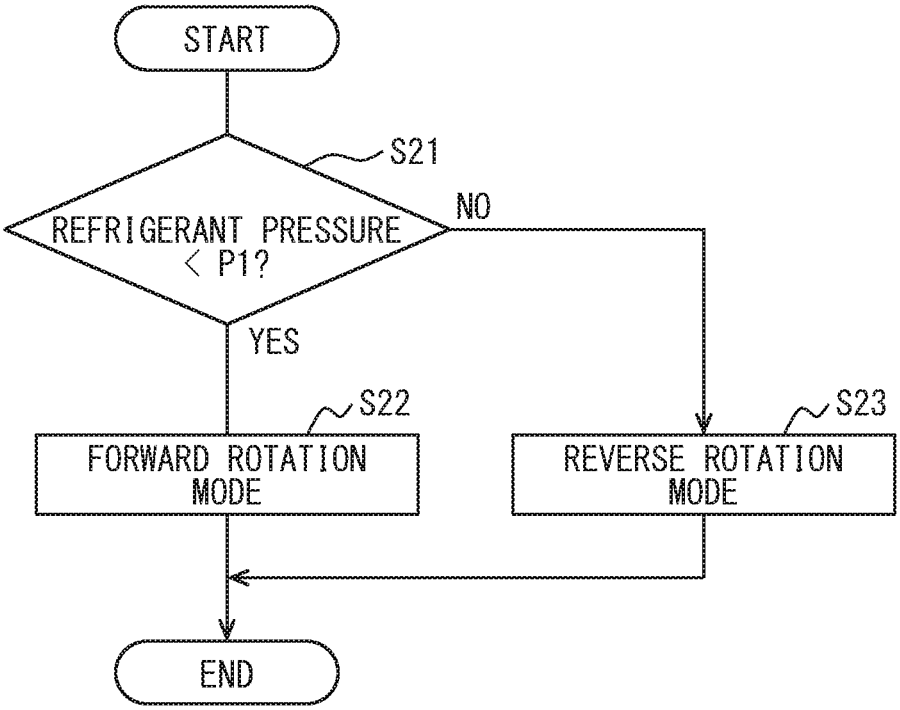
FIG. 8 is a flow chart showing a flow of a processing performed by the controller.

The processing shown in FIG. 8 will be described below. At first, step S21 determines whether or not the pressure of the refrigerant measured by the refrigerant pressure sensor 144 is lower than a predetermined threshold P1. When the pressure of the refrigerant is lower than the threshold P1, the processing is transferred to step S22. At step S22, the forward rotation mode is performed. On the other hand, when the pressure of the refrigerant is equal to or higher than the threshold P1, the processing is transferred to step S23. At step S23, the reverse rotation mode is performed.

When the pressure of the refrigerant is high, a load of the air conditioning is high. Accordingly, the radiation amount from the condenser 210 is large. In this case, if the forward rotation mode is performed, air at high temperature having passed through the condenser 210 is supplied to the radiator 220 positioned at the rearward than the condenser 210, and thereby, the heat radiation from the radiator 220 cannot be performed efficiently. Therefore, when the pressure of the refrigerant is high, the processing is transferred to step S23, and the reverse rotation mode is performed.

On the other hand, when the pressure of the refrigerant is low, the load of the air conditioning is small. Accordingly, the radiation amount from the condenser 210 is small, and the above issue is not caused. Therefore, when the pressure of the refrigerant is low, the processing is transferred to step S22, and the forward rotation mode is performed. In the forward rotation mode, flow rate of air sent from the fan 400 is increased, and the heat radiation at the heat exchanger unit 200 may be performed efficiently.

In a state where the shutter 300 is arranged between the condenser 210 and the radiator 220, air at high temperature having passed through the condenser 210 does not reach the radiator 220 during the inside air cooling control. Therefore, in the state described above, the inside air cooling control may be performed in the forward rotation mode constantly.

As described above, in the cooling system 10 in the present embodiment, when the heat radiation index acquired by the index acquisition unit 120 is equal to or lower than the predetermined threshold T4, the control unit 110 performs the inside air cooling control, in which the fan 400 is driven while the shutter 300 is closed. Therefore, the frequency of opening the shutter 300 can be reduced from that in a conventional system, while the heat exchanger unit 200 keeps performing the heat radiation which is required.

By performing the inside air cooling control, the fuel efficiency of the vehicle MV may be enhanced especially, in particular, when the load of the engine EG is small, for example, when traveling in high-speed cruising or when traveling on a downward slope for long distance.

In the inside air cooling control, when the pressure of the refrigerant which passes through the condenser 210 is lower than the threshold P1, the control unit 110 controls such that the fan 400 operates in the forward rotation mode. On the other hand, when the pressure of the refrigerant which passes through the condenser 210 is higher than the threshold P1 in the inside air cooling control, the control unit 110 controls the fan 400 to be operated in the reverse rotation mode. Therefore, the radiator 220 may be restricted from receiving thermal damage from the condenser 210, and the heat radiation at the heat exchanger unit 200 may be performed efficiently.

The control unit 110 does not perform the inside air cooling control, in a case where the vehicle speed of the vehicle MV is equal to or lower than the threshold speed V1. Therefore, reduction of the fuel efficiency of the vehicle MV caused due to the inside air cooling control may be restricted.

In a determination at step S09 or step S11 described above, the coolant temperature is used as the heat radiation index. In the determination at step S09, the lubricating oil temperature acquired by the lubricating oil temperature sensor 142 may be used as the heat radiation index. Further, the coolant temperature and the lubricating oil temperature may be used as the heat radiation index in the determination at step S09.

In the present embodiment, an example in which the heat exchanger unit 200 is configured by two heat exchangers is described. However, the heat exchanger unit 200 may be configured by one heat exchanger or three or more heat exchangers.

In the present embodiment, at step S11 in FIG. 7, when the coolant temperature, which is the heat radiation index, is higher the threshold T3, the processing is transferred to step S13, and the fan 400 starts driving. The threshold T3 may be set as a temperature at which a thermostat becomes in an open state to start a supply of the coolant to the radiator 220. The threshold T3 may be set as a temperature which is slightly lower than the upper limit temperature of a temperature range of the coolant to be maintained to prevent overheating.

In a case where the pressure of the refrigerant which passes the condenser 210 is used as the heat radiation index, the threshold T3 may be set as the pressure of the refrigerant at which the fan 400 is required to drive so as to cool the condenser 210.

A second embodiment will be described below. In below, the structure different from the first embodiment will be mainly described in order to eliminate explanation for the same structures.

The second embodiment is different from the first embodiment only in an example of a control performed by the control unit 110. An improvement effect of fuel consumption of the vehicle MV in the inside air cooling control of the control unit 110 will be described below with reference to FIG. 9, before the description of the control starts.

Figure 9:
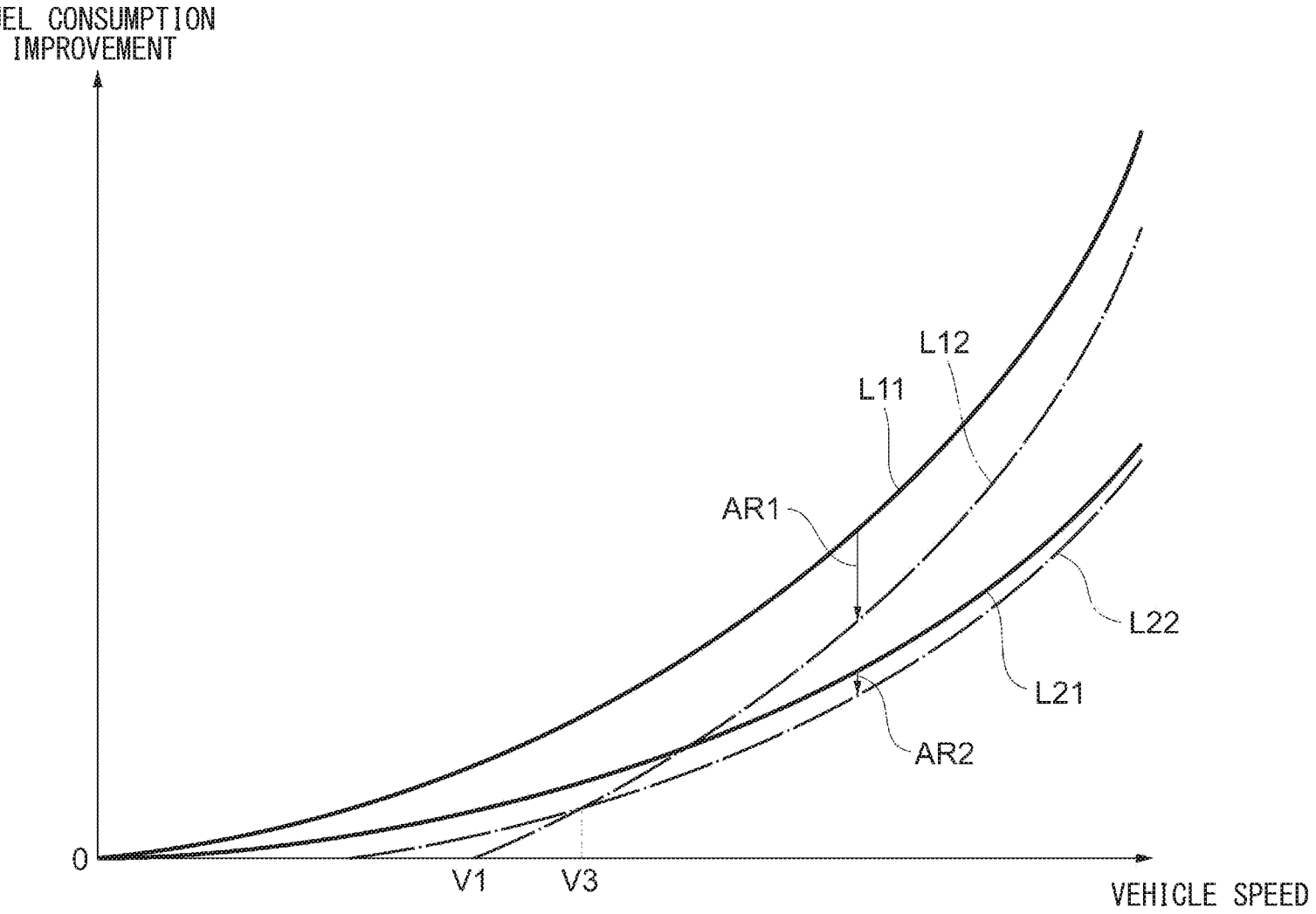
FIG. 9 is a graph to explain an improvement effect of fuel consumption by an inside air cooling control.

As known, in a state where the shutter 300 is closed, the vehicle MV-received air resistance is reduced. Therefore, the fuel consumption of the vehicle MV in the state where the shutter 300 is closed is enhanced in comparison with that in a state where the shutter 300 is opened. A line L11 in FIG. 9 shows a relationship between the vehicle speed of the vehicle MV (horizontal axis) and the improvement effect of the fuel consumption (vertical axis) in a state where the shutter 300 is closed, that is, opening is 0%. The reduction of the fuel efficiency due to the driving of the fan 400 is not considered to the line L11. As shown by the line L11, the improvement effect of the fuel consumption by closing the shutter 300 increases as the vehicle speed increases.

Similarly to the line L11, a line L12 shows a relationship between the vehicle speed of the vehicle MV (horizontal axis) and the improvement effect of the fuel consumption (vertical axis) when the shutter 300 is closed. However, the reduction of the fuel efficiency due to the driving of the fan 400 is considered to the line L12. That is, the line L12 shows a relationship between the vehicle speed and the improvement effect of the fuel consumption under an actual condition, when the control unit 110 performs the inside air cooling control.

As shown by comparison with the line L11 and the line L12, the improvement effect of the fuel consumption shown by the line L12 is reduced by the consumption of the electricity by the fan 400. In FIG. 9, an arrow AR1 shows the reduction of the improvement effect of the fuel consumption from line L11 to the line L12. The threshold speed V1 is equal to the vehicle speed at which the improvement effect of the fuel consumption of the line L12 is 0.

A line L21 shows a relationship between the vehicle speed of the vehicle MV (horizontal axis) and the improvement effect of the fuel consumption (vertical axis) when the shutter 300 is slightly opened. In an example shown by the line L21, the opening of the shutter 300 is 30%. Similarly to the line L11, the reduction of the fuel efficiency due to the driving of the fan 400 is not considered to the line L21.

The air resistance to the vehicle MV when the opening of the shutter 300 is 30% is smaller than that when the opening of the shutter 300 is 100%. Therefore, the fuel consumption when the opening of the shutter 300 is 30% is enhanced, in comparison with the fuel consumption when the opening of the shutter 300 is 100%. However, the improvement effect of the fuel consumption when the opening of the shutter 300 is 30% is smaller than that when the opening of the shutter 300 is 0% as shown by line L11.

Similarly to the line L21, a line L22 shows a relationship between the vehicle speed of the vehicle MV (horizontal axis) and the improvement effect of the fuel consumption (vertical axis) when the shutter 300 is slightly opened. The reduction of the fuel efficiency due to the driving of the fan 400 is considered to the line L22. That is, the line L22 shows a relationship between the vehicle speed and the improvement effect of the fuel consumption under the actual condition when the opening of the shutter 300 is 30%.

As shown by a comparison between the line L21 and the line L22, the improvement effect of the fuel consumption of the line L22 is reduced by the consumption of the electricity in the fan 400. In FIG. 9, an arrow AR2 shows the reduction of the improvement effect of the fuel consumption from the line L21 to the line L22.

When the shutter 300 is slightly opened, air introduced from the shutter 300 reaches the fan 400. That is, the load of the fan 400 is reduced when the shutter 300 is slightly opened, in comparison with when the opening of the shutter 300 is 0%. Therefore, the reduction shown by the arrow AR2 is smaller than the reduction shown by the arrow AR1.

A difference between the improvement effect of the fuel consumption, shown by the line L12, under the actual condition when the opening of the shutter 300 is 0% and the improvement effect of the fuel consumption, shown by the line L22, under the actual condition when the opening of the shutter 300 is 30% is smaller as the speed of the vehicle MV decreases. As shown in FIG. 9, when the vehicle speed is lower than a speed V3, the improvement effect of the fuel consumption, shown by the line L22, under the actual condition when the opening of the shutter 300 is 30% is larger than the improvement effect of the fuel consumption, shown by the line L12, under the actual condition when the opening of the shutter 300 is 0%. As shown in FIG. 9, the speed V3 is higher than the threshold speed V1.

Therefore, the control unit 110 in the present embodiment is configured such that the opening of the shutter 300 is set at 30% in a case where the vehicle speed of the vehicle MV is lower than the speed V3 shown in FIG. 9. Due to this, the fuel consumption of the vehicle MV is enhanced.

Figure 10:
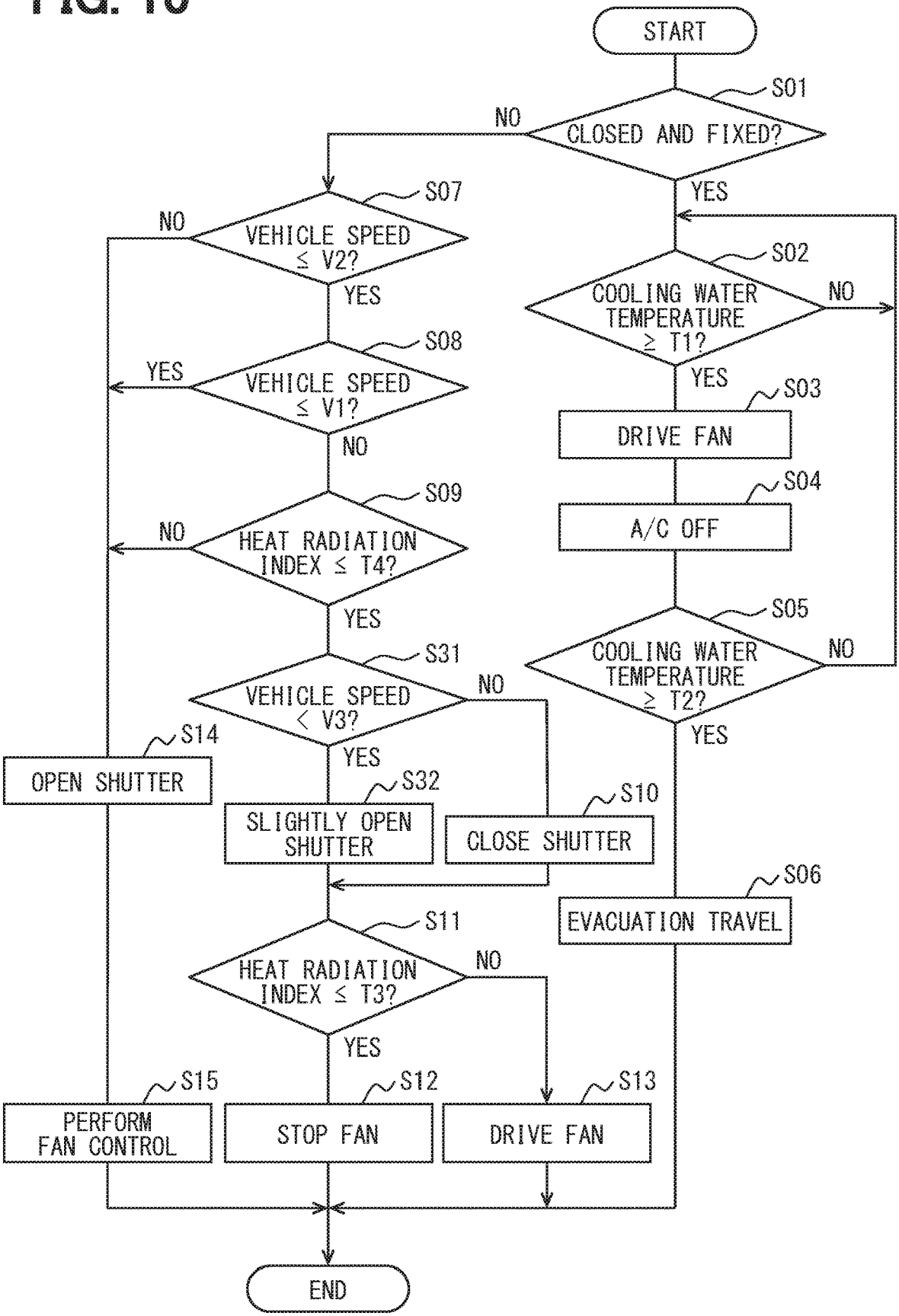
FIG. 10 is a flow chart showing a flow of a processing performed by the controller in a cooling system according to a second embodiment.

Detail of the processing performed by the controller 100 in the present disclosure to perform the control described above will be described with reference to FIG. 10. Series of the processing shown in FIG. 10 are performed instead of the series of the processing shown in FIG. 7. The processing shown in FIG. 10 is different from the processing shown in FIG. 7 in the first embodiment in a processing performed when the determination at step S09 is Yes.

In the present embodiment, when the coolant temperature (heat radiation index) is equal to or lower than the threshold T4 at step S09, the processing is transferred to step S31 in FIG. 10. Step S31 determines whether or not the vehicle speed measured by the vehicle speed sensor 145 is lower than a predetermined lower limit speed V3. The lower limit speed V3 is equal to the speed V3 shown in FIG. 9. That is, the lower limit speed V3 is set beforehand as a lower limit value of a speed range in which the improvement effect of the fuel consumption when the shutter 300 is closed is larger than that when the shutter 300 is slightly opened. The lower limit speed V3 is a value higher than the threshold speed V1. The lower limit speed V3 is appropriately adapted correspondingly to the opening (30% in the example) such that the shutter 300 is slightly opened.

When the vehicle speed is lower than the lower limit speed V3, the processing is transferred to step S32. In this case, the fuel consumption is enhanced in a state where the inside air cooling control is performed when the shutter 300 is slightly opened, rather than when the shutter 300 is closed. Therefore, at step S32, a processing to open the shutter 300 slightly, more specifically, processing to set the opening 30% is performed. Subsequently, the processing is transferred to step S11.

At step S31, when the vehicle speed is equal to or higher the speed V3, the processing is transferred to step S10. In this case, similarly to step S10 in FIG. 7, the processing to close the shutter 300 is performed. Subsequently, the processing is transferred to step S11.

As described above, the control unit 110 in the present embodiment controls the fan 400 to be driven after the opening of the shutter 300 is set lower than 100%, e.g) 30% in the present embodiment, when the vehicle speed of the vehicle MV is lower than the predetermined lower limit speed V3 which is a higher value than the threshold speed V1, even when the vehicle speed of the vehicle MV is higher than the threshold speed V1, that is, when the determination at step S08 is No. Due to this, the fuel consumption during a traveling at low speed is enhanced.

The above embodiments of the present disclosure have been described according to the concrete examples. However, the present disclosure is not limited by above examples. The present disclosure can be further modified in various manners as described below. The present disclosure is not limited by the elements, the locations, the conditions, the shapes or the like in above concrete examples and can be modified. The present disclosure also includes various combinations and structures of the embodiments and other combinations and configurations including only one element of the embodiments, more of the elements of the embodiments, and less of the elements of the embodiments.

What is claimed is:

1. A cooling system for a vehicle comprising:

a heat exchanger unit configured to cool a heat medium by heat exchange with air;

a fan configured to send air to flow through the heat exchanger unit;

a shutter configured to switch between an opening and a closing of a pathway through which air flows from an outside of the vehicle toward the heat exchanger unit;

a control unit configured to control an operation of the fan and an operation of the shutter;

an index acquisition unit configured to acquire a heat radiation index that is an index showing a magnitude of a radiation amount required in the heat exchanger unit; and a fixing determination unit configured to determine whether the shutter is closed and fixed, wherein the control unit performs an inside air cooling control in which the fan is driven while the shutter is closed, when the heat radiation index is equal to or lower than a predetermined threshold and when the fixing determination unit determines the shutter is closed and fixed, the control unit is configured to perform a forward rotation mode in which the fan rotates to send air from the fan toward a rearward of the vehicle, and to perform a reverse rotation mode in which the fan rotates to send air from the fan toward a frontward of the vehicle, the heat exchanger unit includes a condenser configured to exchange heat between a refrigerant and air and a radiator configured to exchange heat between a coolant and air, the radiator is placed more rearward of the vehicle than the condenser, the shutter is placed more frontward of the vehicle than the condenser, the control unit performs the inside air cooling control in the forward rotation mode when a pressure of the refrigerant flowing through the condenser is lower than a predetermined threshold, and the control unit performs the inside air cooling control in the reverse rotation mode when a pressure of the refrigerant flowing through the condenser is higher than the predetermined threshold.

2. The cooling system according to claim 1, wherein the index acquisition unit is configured to acquire a temperature of coolant or lubricating oil that flows in an engine of the vehicle as the heat radiation index.

3. A cooling system for a vehicle comprising:

a heat exchanger unit configured to cool a heat medium by heat exchange with air;

a fan configured to send air to flow through the heat exchanger unit;

a shutter configured to switch between an opening and a closing of a pathway through which air flows from an outside of the vehicle toward the heat exchanger unit;

a control unit configured to control an operation of the fan and an operation of the shutter; and an index acquisition unit configured to acquire a heat radiation index that is an index showing a magnitude of a radiation amount required in the heat exchanger unit, wherein the control unit performs an inside air cooling control in which the fan is driven while the shutter is closed, when the heat radiation index is equal to or lower than a predetermined threshold, the control unit is configured to perform a forward rotation mode in which the fan rotates to send air from the fan toward a rearward of the vehicle, and to perform a reverse rotation mode in which the fan rotates to send air from the fan toward a frontward of the vehicle, an under duct is provided in the vehicle to guide air that has passed through the heat exchanger unit in the reverse rotation mode to flow toward the engine, an opening is provided at a front end of the under duct and is opened to a position between the shutter and the heat exchanger unit, and the heat exchanger unit, the fan, and the shutter are located such that air that has passed through the heat exchanger unit is supplied toward the engine through the under duct, when the inside air cooling control is performed in the reverse rotation mode.

4. A cooling system to be equipped in a vehicle, the cooling system comprising:

a heat exchanger unit configured to cool a heat medium by heat exchange with air;

a fan configured to send air to flow through the heat exchanger unit;

a shutter configured to switch between an opening and a closing of a pathway through which air flows from an outside of the vehicle toward the heat exchanger unit;

a control unit configured to control an operation of the fan and an operation of the shutter; and an index acquisition unit configured to acquire a heat radiation index that is an index showing a magnitude of a radiation amount required in the heat exchanger unit, wherein the control unit performs an inside air cooling control in which the fan is driven while the shutter is closed, when the heat radiation index is equal to or lower than a predetermined threshold, and the control unit is configured to perform a control other than the inside air cooling control, in a case where a vehicle speed of the vehicle is equal to or lower than a predetermined threshold speed set as a lower limit value of a vehicle speed range suitable to perform the inside air cooling control, or in a case where a vehicle speed is more than a predetermined upper limit speed of a vehicle speed range in which the shutter is prevented from being broken when the vehicle drives under a condition that the shutter is closed.

5. The cooling system according to claim 4, wherein the control unit is configured to drive the fan after an opening of the shutter becomes lower than 100% in a case where the vehicle speed of the vehicle is lower than a predetermined lower limit speed that is a higher value than the threshold speed, even when the vehicle speed of the vehicle is higher than the threshold speed.

* * * * *